US008936374B1

(12) United States Patent
Royse

(10) Patent No.: US 8,936,374 B1
(45) Date of Patent: Jan. 20, 2015

(54) TURF PROTECTION SYSTEM AND LED FLOORING SYSTEM FOR PRESERVING NATURAL TURF

(76) Inventor: John P. Royse, Bellefonte, PA (US)

( * ) Notice: Subject to any disclaimer, the term of this patent is extended or adjusted under 35 U.S.C. 154(b) by 223 days.

(21) Appl. No.: 13/347,018

(22) Filed: Jan. 10, 2012

(51) Int. Cl.
*F21S 8/00* (2006.01)

(52) U.S. Cl.
USPC ..... 362/153; 404/35

(58) Field of Classification Search
CPC ..... F21S 8/022; F21S 8/032; F21S 4/003; G09F 19/228; G09F 2013/0495; A63C 19/12
USPC ..... 362/384, 383, 382, 153; 404/22, 35, 47
See application file for complete search history.

(56) References Cited

U.S. PATENT DOCUMENTS

| | | | | |
|---|---|---|---|---|
| 4,329,739 | A * | 5/1982 | Loebner | 362/153 |
| 4,330,906 | A * | 5/1982 | Werner | 24/136 R |
| 4,340,929 | A * | 7/1982 | Konikoff et al. | 362/153 |
| 6,007,271 | A * | 12/1999 | Cole et al. | 404/35 |
| 6,116,751 | A * | 9/2000 | Remp | 362/153 |
| 6,732,478 | B1 * | 5/2004 | Russell et al. | 52/28 |
| 7,119,704 | B2 * | 10/2006 | Grzan et al. | 340/665 |
| 7,670,026 | B1 * | 3/2010 | Hawkins | 362/249.05 |
| 8,206,002 | B1 * | 6/2012 | Olson | 362/153.1 |
| 8,444,287 | B2 * | 5/2013 | Hardesty | 362/153 |
| 2004/0013824 | A1 * | 1/2004 | Sibbet | 428/17 |
| 2007/0058368 | A1 * | 3/2007 | Partee et al. | 362/231 |
| 2008/0120901 | A1 * | 5/2008 | Hinsperger | 47/20.1 |
| 2009/0091924 | A1 * | 4/2009 | Tsao et al. | 362/153 |
| 2009/0197710 | A1 * | 8/2009 | Ronda | 473/490 |
| 2010/0265731 | A1 * | 10/2010 | Van Herpen et al. | 362/543 |
| 2011/0090693 | A1 * | 4/2011 | Liu et al. | 362/249.02 |
| 2011/0120037 | A1 * | 5/2011 | Barlow | 52/309.1 |

* cited by examiner

*Primary Examiner* — Julie Bannan
(74) *Attorney, Agent, or Firm* — John J. Elnitski, Jr.

(57) ABSTRACT

A turf protection system that includes lights to continue providing turf lighting requirements, so as to reduce and even prevent turf deterioration. The system includes at least one flooring section having a top, bottom, four sides formed to mate sides of another of the at least one flooring section. The flooring section includes ground supports extending from an inside surface of flooring section to support the at least one flooring section on a surface. The flooring section includes voids between the ground supports to receive attachment of the lights between the ground supports such that the ground supports protect the lights contacting the surface the flooring sections is supported from. The at least one flooring section in combination with the ground supports being construction to support weight of heavy equipment such as vehicle and event stages in order to protect the lights.

19 Claims, 15 Drawing Sheets

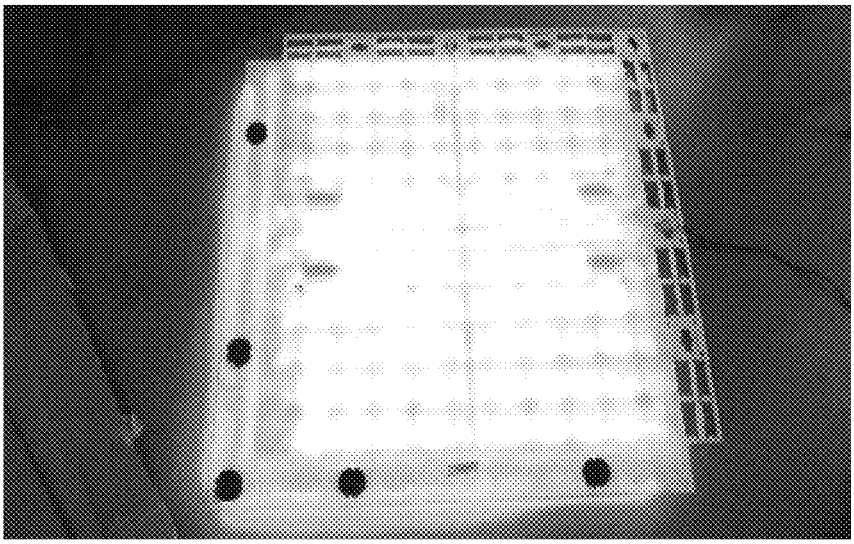
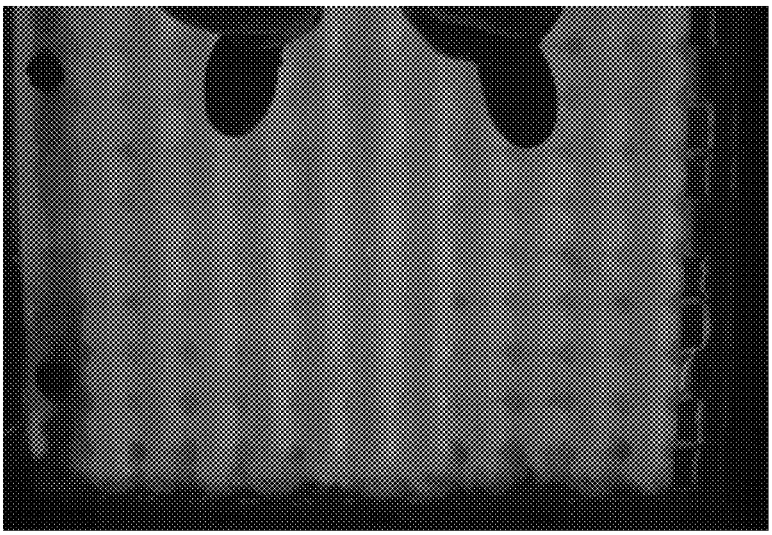
Fig. 13

TURF PROTECTION SYSTEM AND LED FLOORING SYSTEM FOR PRESERVING NATURAL TURF

BACKGROUND

The present invention relates generally to apparatus and methods of preserving natural turf when covered for an event, and more particularly to apparatus that can support vehicles or heavy objects.

Morphological changes in turf grass can occur within 4 to 7 days of exposure to reduced irradiance levels. An estimated 20 to 25% of the lawns in the United States are grown under some degree of tree or structural shade stress. Turf grass may survive in as little as 5% of full sunlight under no traffic. Growth and development of turf grass is greatly influenced by both the quality and the quantity of light available for photosynthesis. However, depending on species and management 22-35% of sunlight is required for normal turf growth.

Stadiums and other venues host major events on natural turf playing surfaces. Areas of turf grass are typically damaged after a major event in the areas where a stage sits, and the areas where construction of the stage takes place due to a lack of sunlight. The current method for providing a base on which a stage can be placed on natural turf consists of layers of plywood and Inka mat that is placed directly on top and covering the turf. The layers of this base provide a solid surface on which to place the stage. The plywood areas, sometimes referred to as "corn chips", are left on the natural turf for up to six days straight to allow for placement of stage bases, event rehearsal, performance and subsequent deconstruction of the stage. The after-effects of a larger event can devastate up to one fifth of the covered area. The result of covering the turf is that the turf is wilted, discolored, and even dead. Before using the turf areas again, the areas of turf that have been covered for six or more days need adequate time to recover from the lack of sunlight. The typical time of recovery or total replacement of turf is usually three to six days and delay the use of the turf for its intended purpose, may not be acceptable to the owner of the turf.

It is an object of the present invention to provide uninterrupted photosynthesis to turf while covered during a major event where the covered area is without direct sunlight for an extended period of time.

It is an object of the present invention to provide a system that aids in preserving the turf to be covered and allow the use of vehicles and heavy objects while the turf is covered.

SUMMARY OF THE INVENTION

A turf protection system that includes lights to continue providing turf lighting requirements, so as to reduce and even prevent turf deterioration. The system includes at least one flooring section having a top, bottom, four sides formed to mate sides of another of the at least one flooring section. The flooring section includes ground supports extending from an inside surface of flooring section to support the at least one flooring section on a surface. The flooring section includes voids between the ground supports to receive attachment of the lights between the ground supports such that the ground supports protect the lights contacting the surface the flooring sections is supported from. The at least one flooring section in combination with the ground supports being construction to support weight of heavy equipment such as vehicle and event stages in order to protect the lights.

BRIEF DESCRIPTION OF DRAWINGS

FIG. 10 is a perspective view of a flooring section according to the present invention.

FIG. 13 is a photo of the colored LED lights shining through a flooring section according to the present invention.

DETAILED DESCRIPTION

The most limiting yet essential factor for the turf throughout the duration of the event on the turf is the lack of sunlight when covered. The present invention provides the turf area to be covered with the wavelengths of 400-800 nm of light through Light Emitting Diodes (LED). Blue and red light from the LEDs of the present invention allows the required uninterrupted photosynthesis to take place during use of the present invention. The present invention allows stage footings to sit directly on the LED lighting. The present invention provides portable units that can be placed under the stage, as well as around the stage to allow construction equipment to safely pass over the turf without damage, while providing light to protect the turf.

Figure 3:
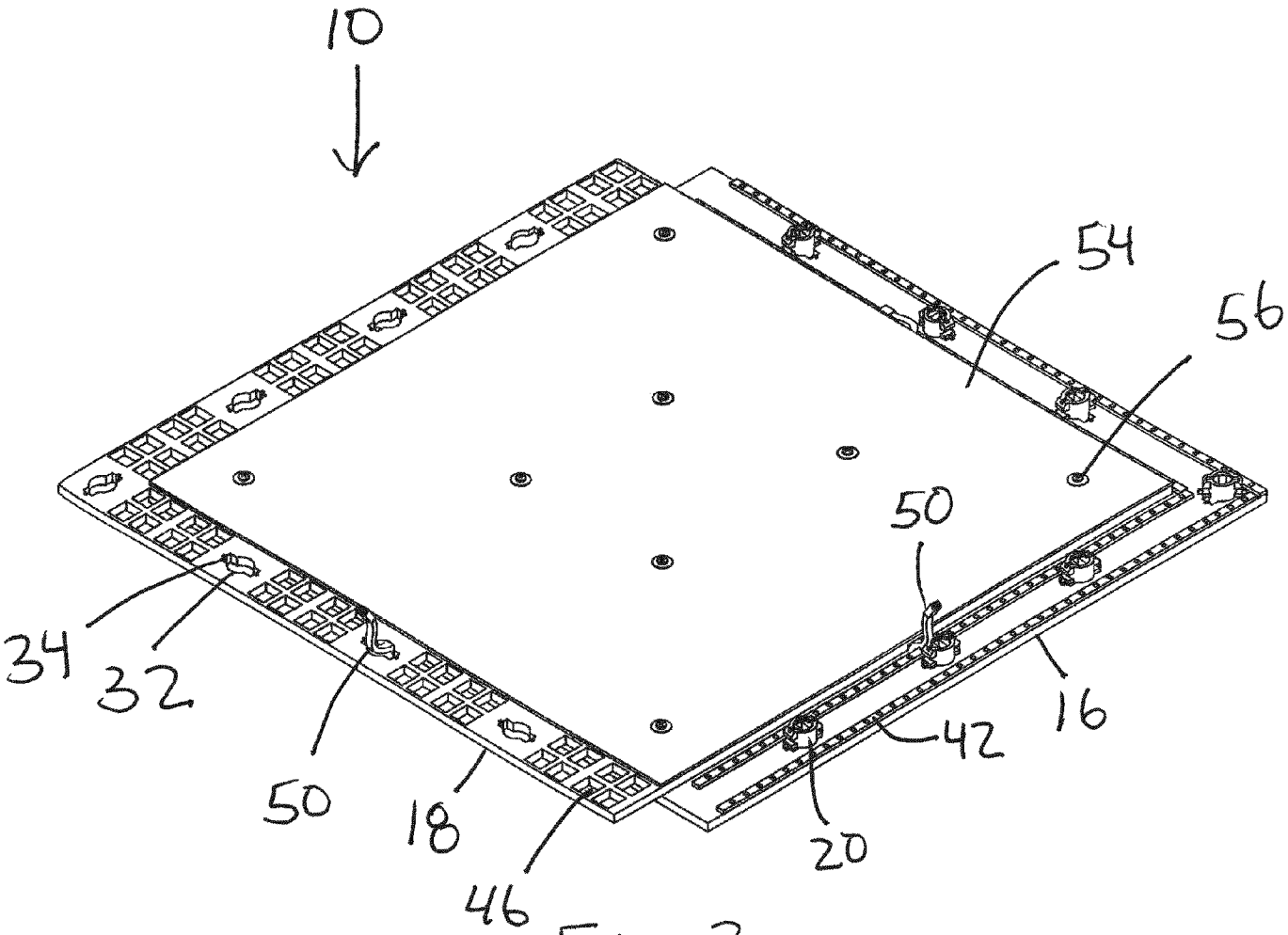
FIG. 3 is a perspective view a flooring section according to the present invention.
Figure 4:
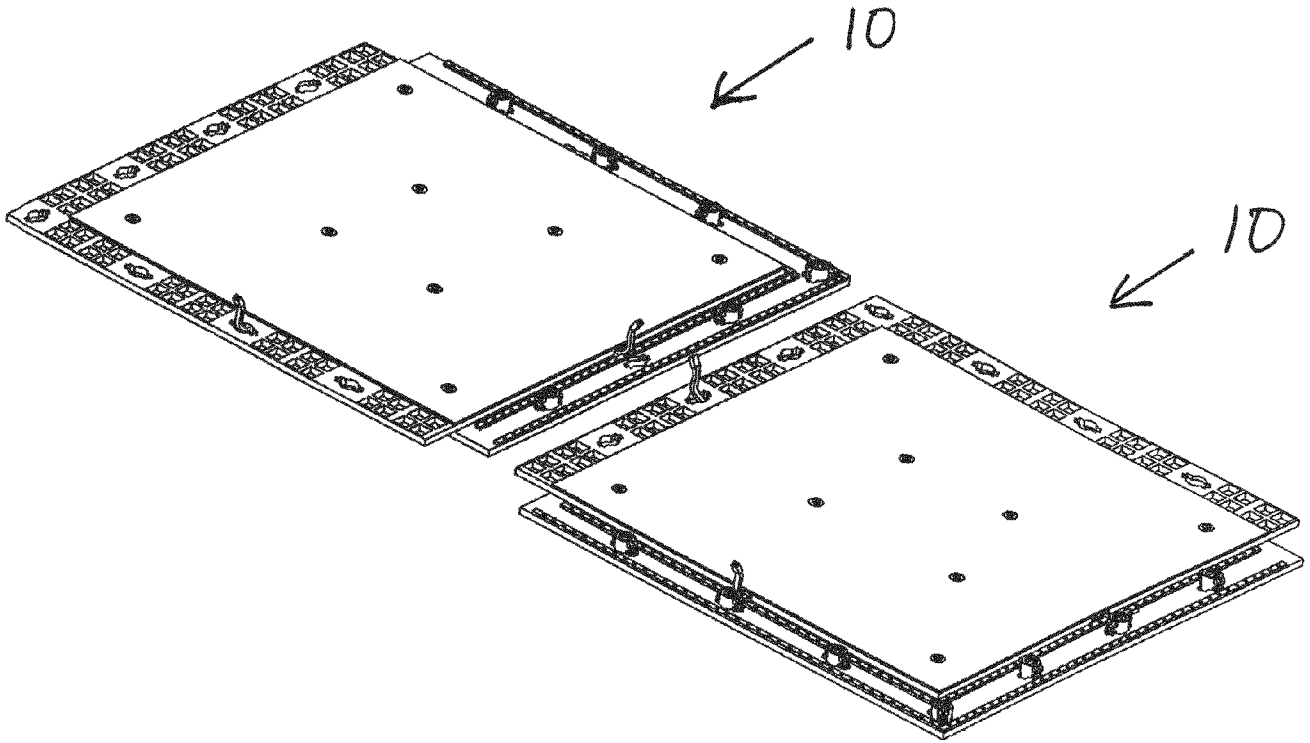
FIG. 4 is a perspective view of two flooring sections according to the present invention.
Figure 5:
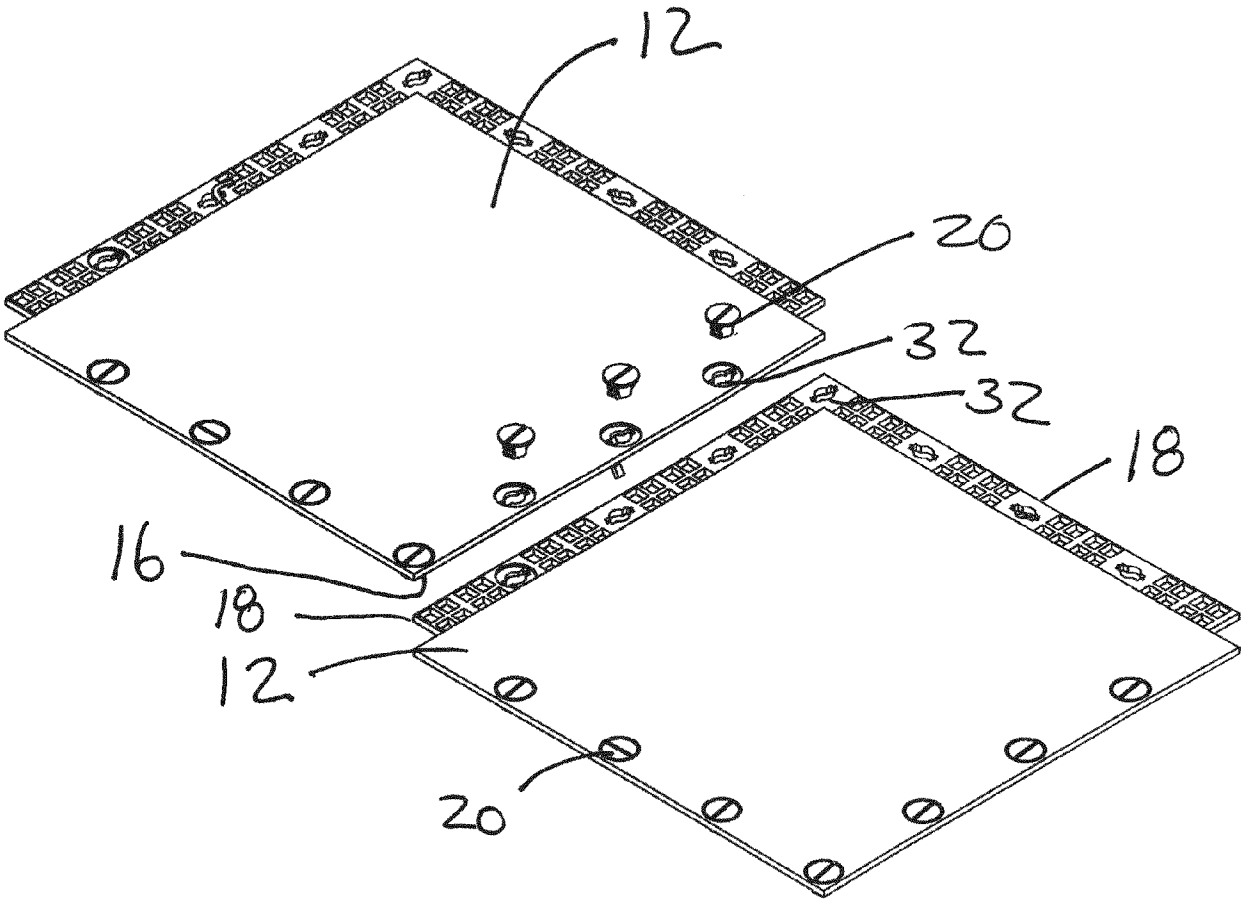
FIG. 5 is a perspective view of two flooring sections according to the present invention.
Figure 6:
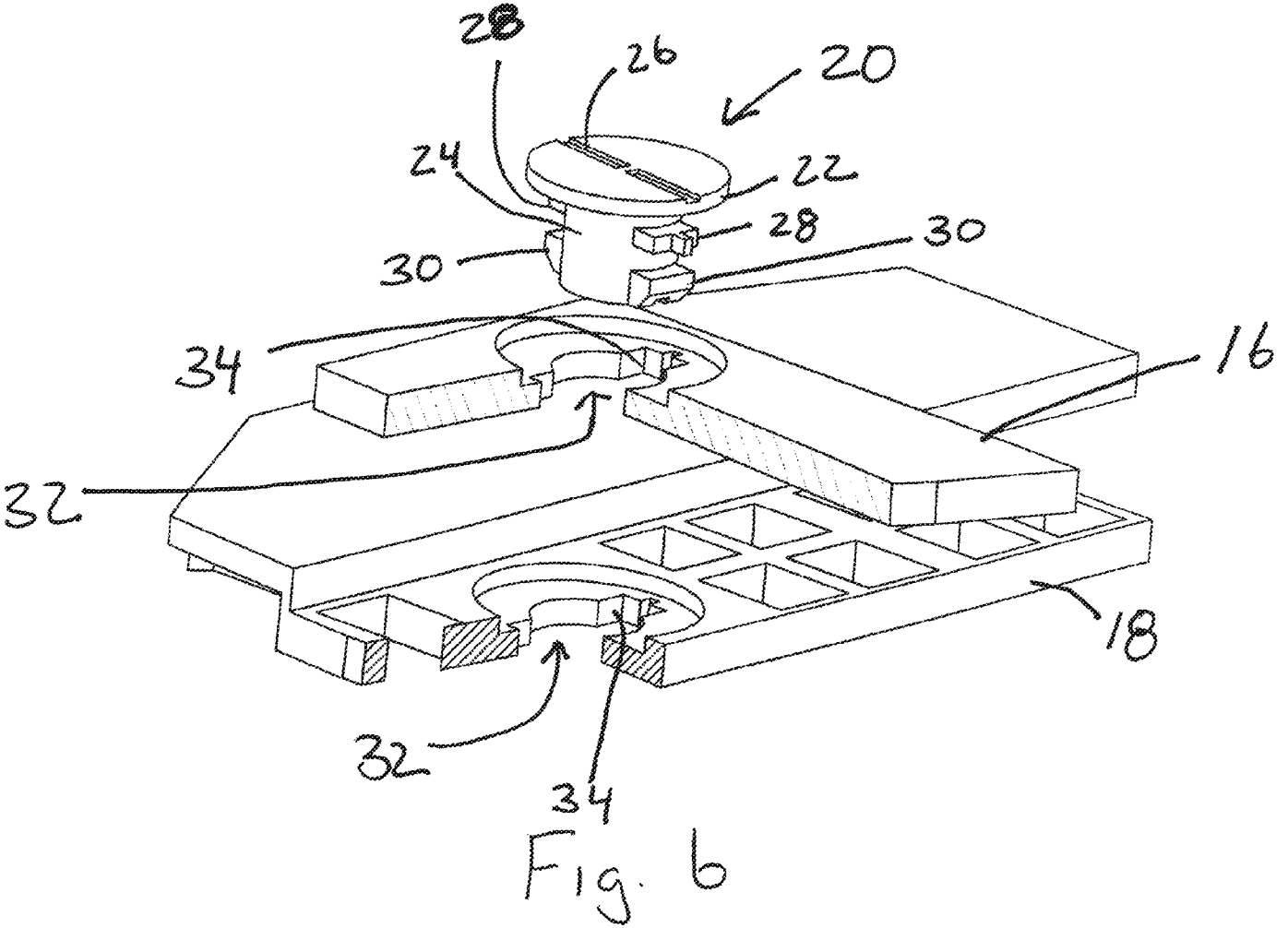
FIG. 6 is a perspective view of connecting two flooring sections according to the present invention.
Figure 7:
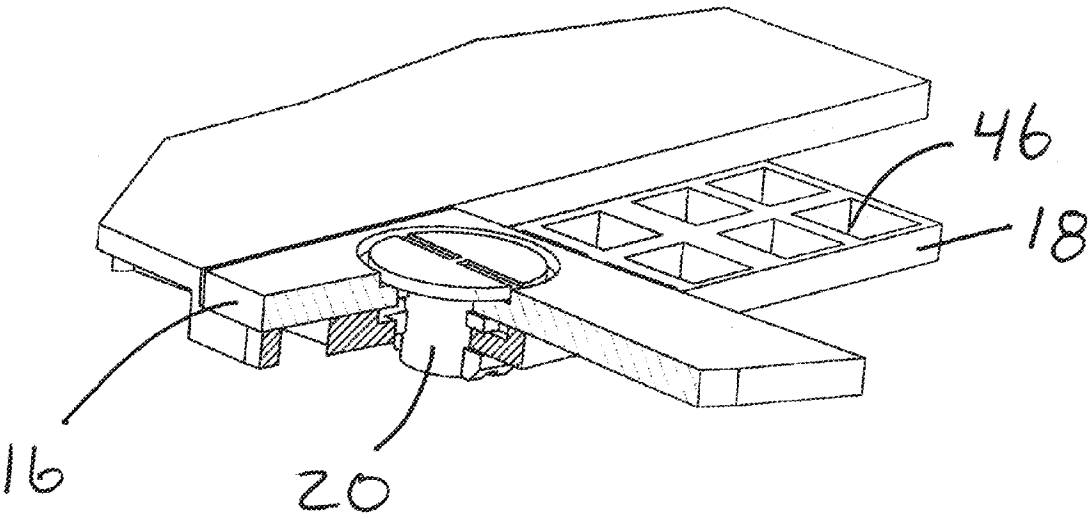
FIG. 7 is a perspective view of connecting two flooring sections according to the present invention.

The present invention is turf protection system using a LED enhanced flooring to cover natural turf. The system is divided into pallet-sized flooring sections 10 that are attachable to each other, as shown in FIGS. 1-5. Each flooring section 10 includes four sides, a top 12 and a bottom 14. FIGS. 1-4 show a bottom view of the flooring section 10. The four sides are used to interconnect flooring sections 10. Each flooring section 10 includes two key sides 16 and two key receiving sides 18. The key side 16 connects to the key receiving side 18 of another flooring section 10 to lock the flooring sections 10 together, as shown in FIGS. 4-5. FIGS. 6-7 show a close up how the flooring sections 10 are locked together. The key side 16 includes a series of keys 20. Each key 20 includes a face plate 22 and key body 24. FIGS. 6-7 show the face plate 22 having two slots 26 and the key body 24 having two opposing upper locking lugs 28 and two opposing lower locking lugs 30. Both the key sides 16 and key receiving sides 18 include key holes 32. FIGS. 5-6 show the key side 16 is placed on top of the key receiving side 18, so that key holes 32 of both align with each other. The key holes 32 include opposing lug slots 34, such that the key 20 can be inserted into the key holes 32 with the upper locking lugs 28 and the lower locking lugs 30 passing through the lug slots 34. The key 20 can then be turned using the face plate slots 26, such that the upper locking lugs 28 and the lower locking lugs 30 turn beyond the lug slots 34. Together the face plate 22, upper locking lugs 28 and the lower locking lugs 30 lock the key sides 16 and key receiving sides 18 together.

Figure 1:
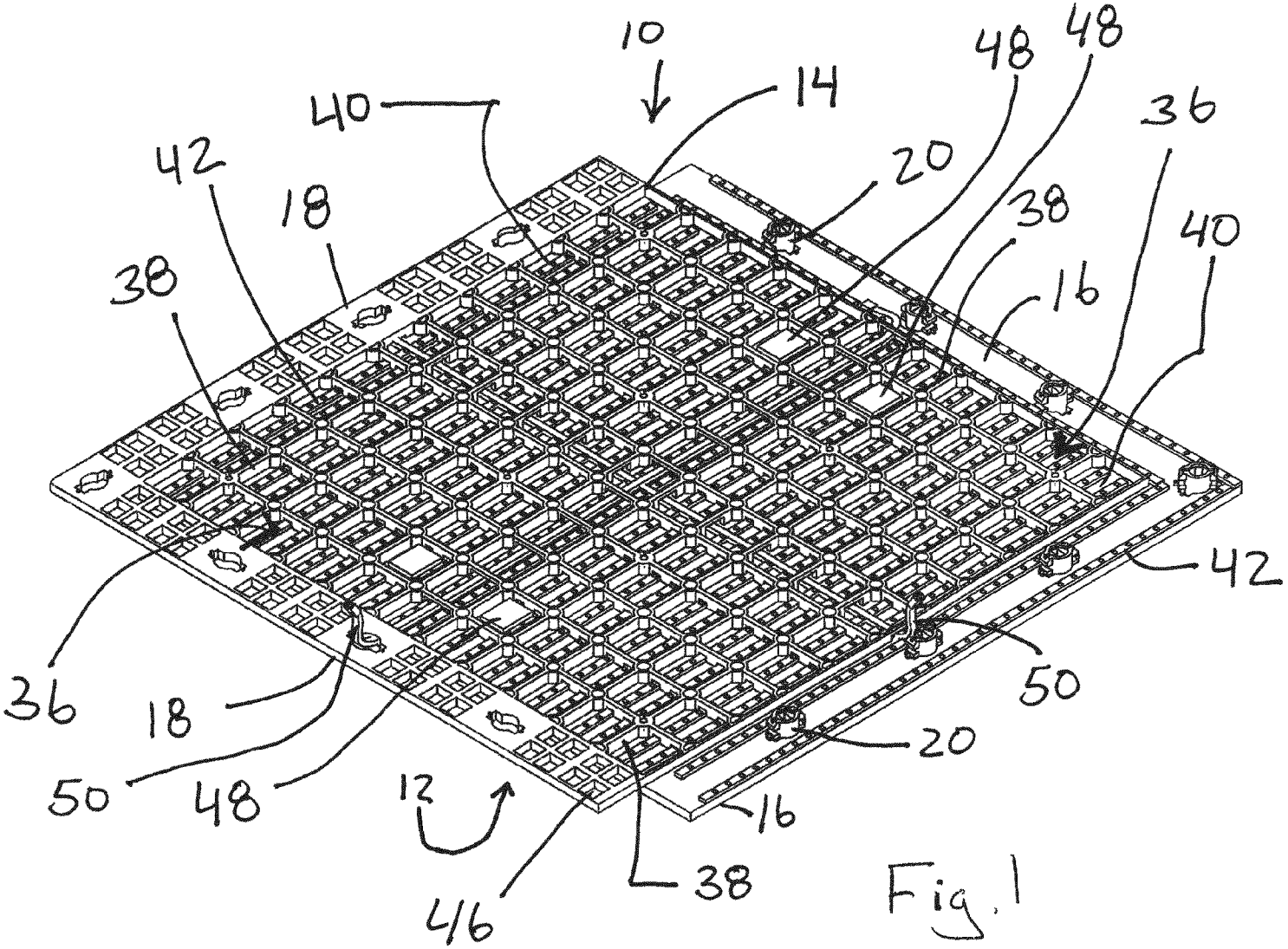
FIG. 1 is a perspective view a flooring section according to the present invention.
Figure 2:
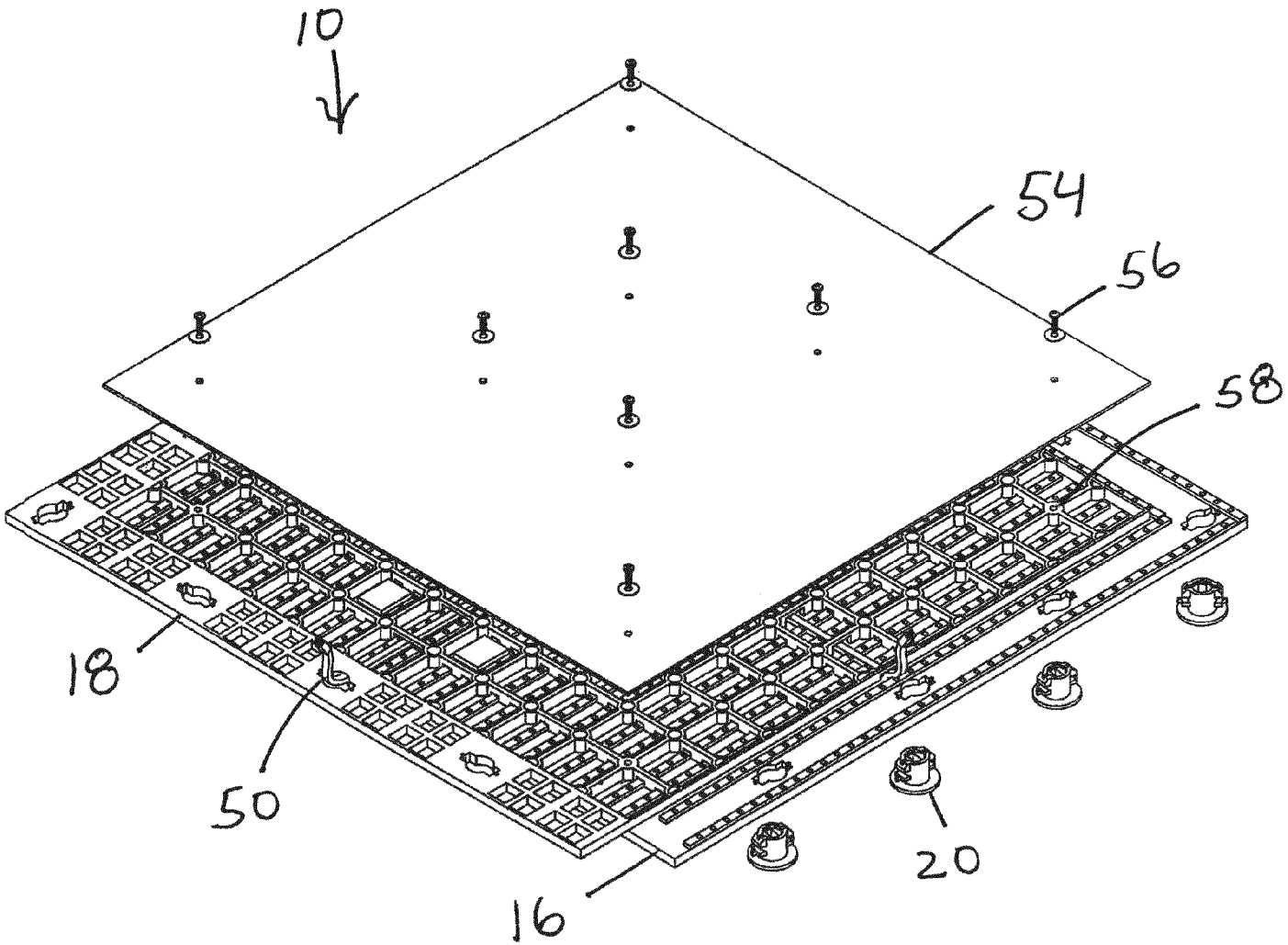
FIG. 2 is a perspective view a flooring section according to the present invention.
Figure 8:
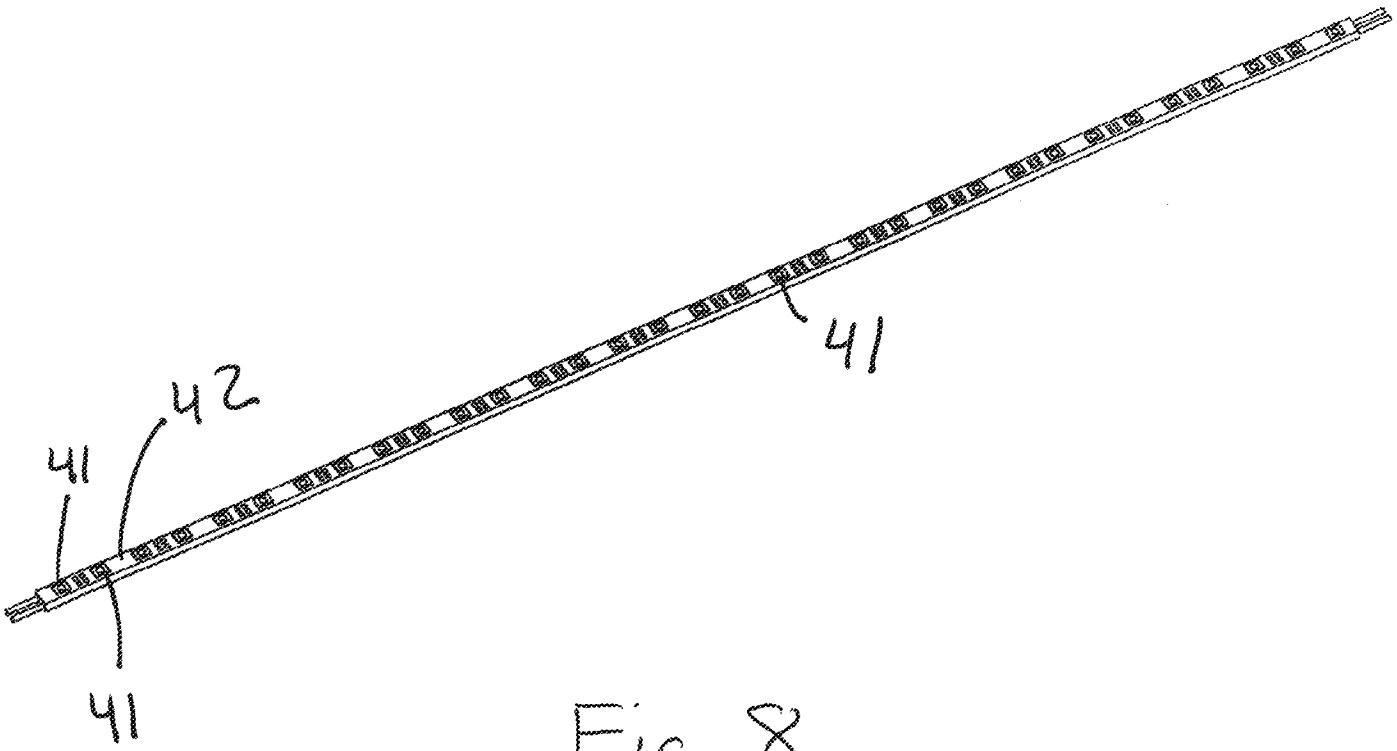
FIG. 8 is a perspective view of a lighting strip according to the present invention.
Figure 9:
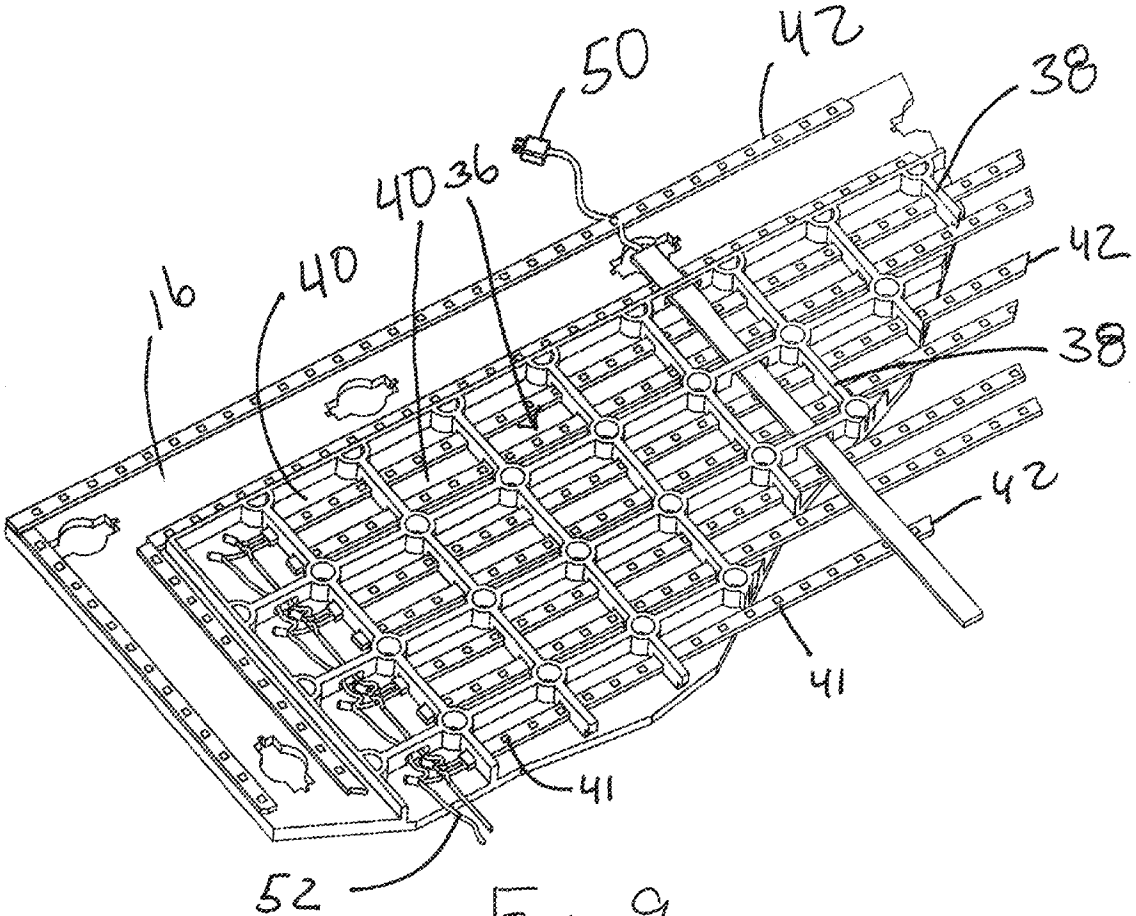
FIG. 9 is a perspective view of a flooring section according to the present invention.

FIGS. 1-2 show the bottom of the flooring section 10 including a honeycomb style pattern of openings 36 formed by a support framework of ground support strips 38. The ground support strips 38 extend from an inside surface 40 of material that forms the solid top 12 of flooring section 10. The ground support strips 38 are designed to contact the surface that the flooring sections 10 will be placed upon, while providing spacing for lighting between the top 12 and that surface. The ground support strips 38 provide the structural support so that the lighting is not crushed when weight is applied to the top 12 of the flooring sections 10. The flooring section 10 with the combination of the top 12 and honeycomb pattern of ground support strips 38 can withstand weights up to 1,056 pounds per square inch or about 150 tons of weight. Each flooring section 10 includes LEDs 41 enrobed in waterproof lighting strips 42, as shown in FIG. 8. The lighting strips 42 are attached to the inside surface 40 of the flooring section 10. A close up is shown in FIG. 9, showing the lighting strips 42 running through the ground support strips 38. FIG. 10 shows light slots 44 cut out of the ground supports strips 38 to allow passage of the LED lighting strips 42. The key receiving sides 18 include light openings 46, as shown in FIGS. 1-7. The key sides 16 include the light strips 42 embedded into the key sides 16, as shown in FIGS. 2-4 and 9. This allows for additional light to emit through the light openings 46. FIGS. 1-2 show power supply modules 48 to control and regulate power to the lighting strips 42. FIGS. 1-4 and 9 show power connections 50 to interconnect the flooring sections 10 together. At least one of the power connections 50 would be connected to a main power supply of an external source to power all of the flooring sections 10 that are used. FIG. 9 also shows wiring 52 interconnecting the individual lighting strips 42 together. FIGS. 2-3 show a clear protective layer 54 attached to the bottom 14 of the flooring sections 10 using screws 56 and screw holes 58 in the ground support strips 38. The clear protective layer 54 can be clear acrylic plastic and is used to protect the lighting strips 42 and wiring 52. The clear protective layer 54 can act as a light diffuser. Alternatively, the clear protective layer 54 can be replaced with a layer of netting to allow air to circulate.

Figure 11D:
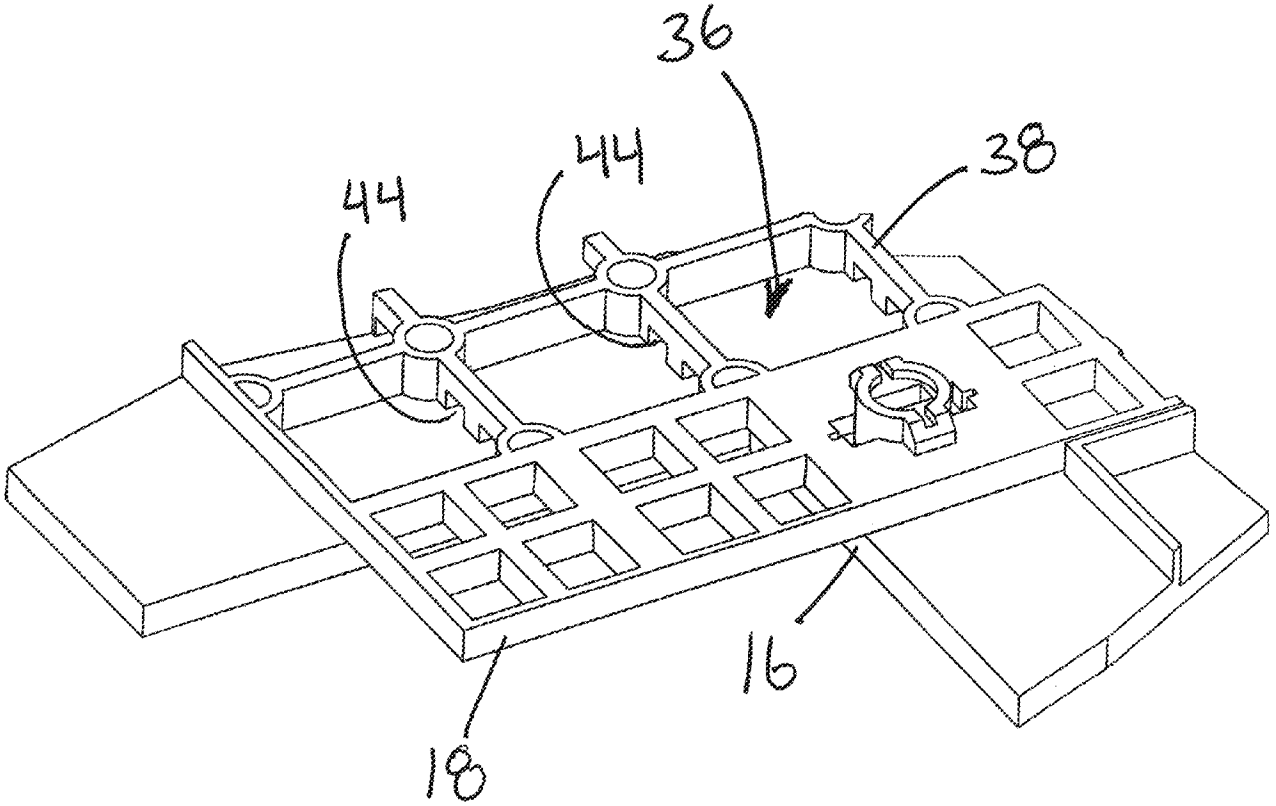
FIG. 11 is a perspective view of a flooring section according to the present invention.
Figure 11:
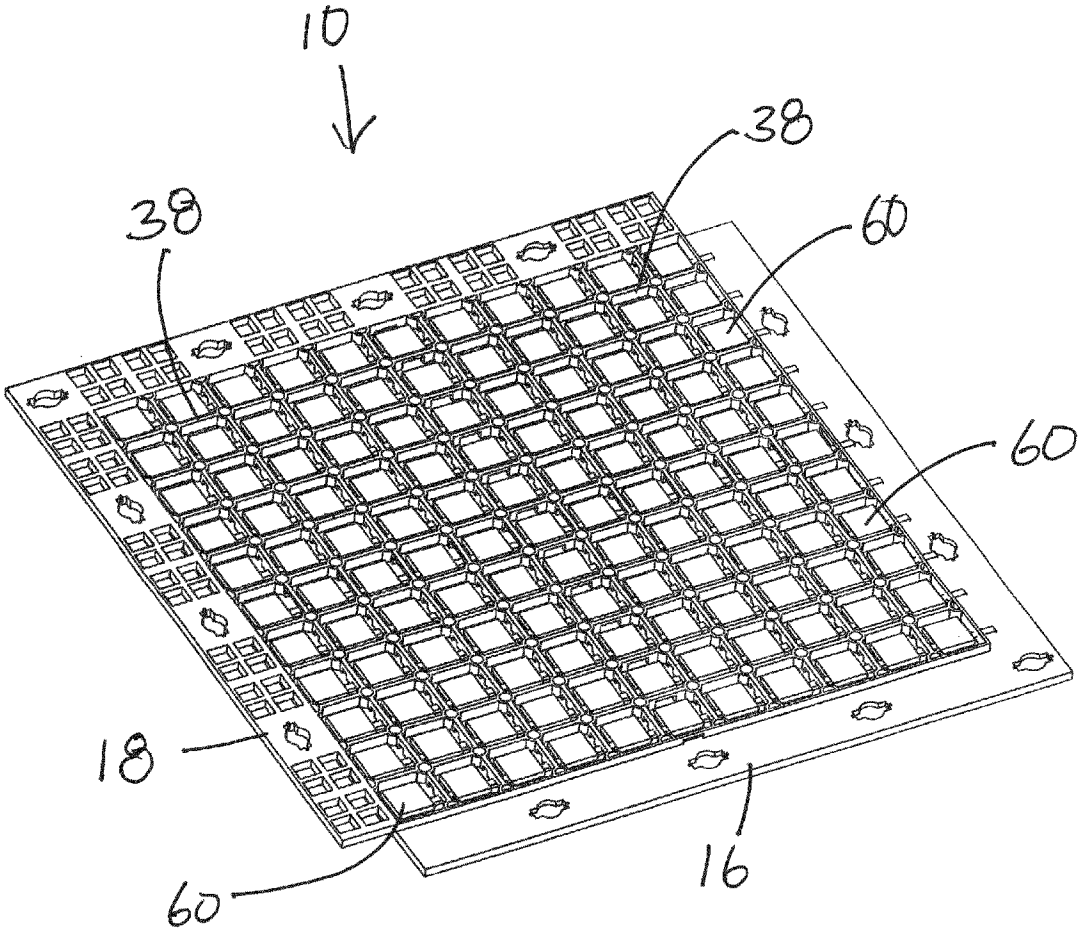
Figure 12:
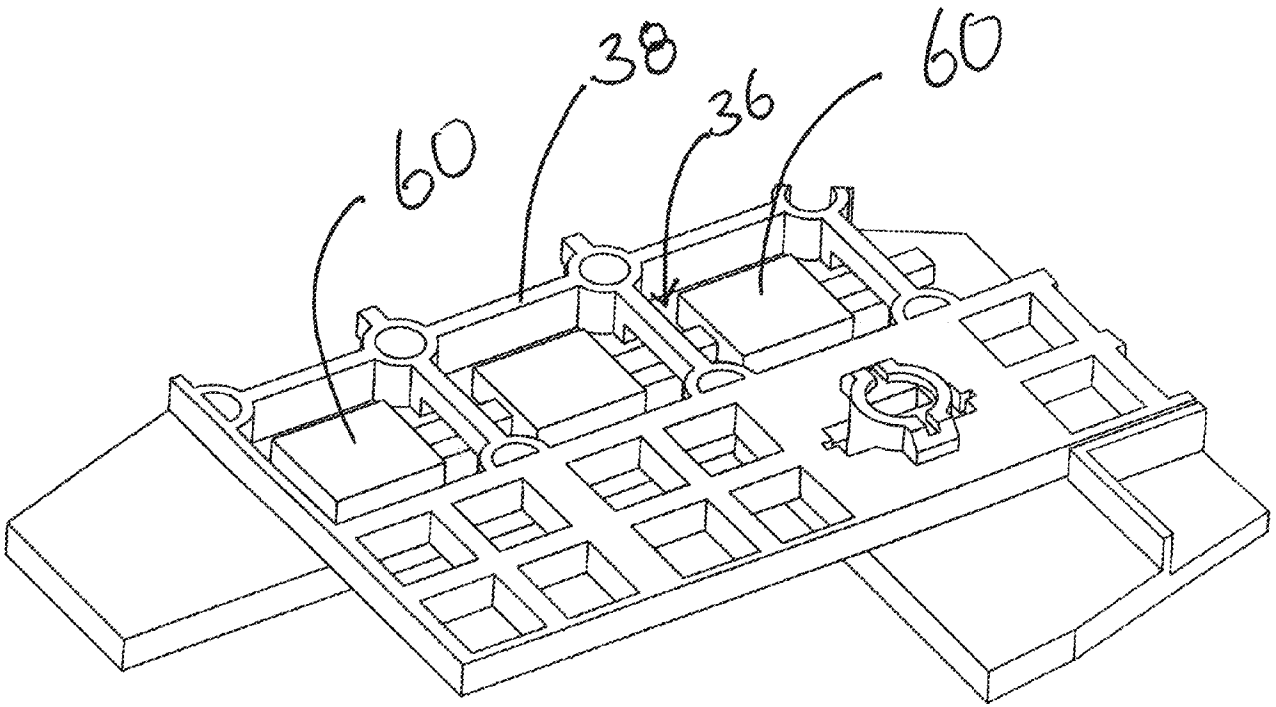
FIG. 12 is a perspective view of a flooring section according to the present invention.
Figure 14:
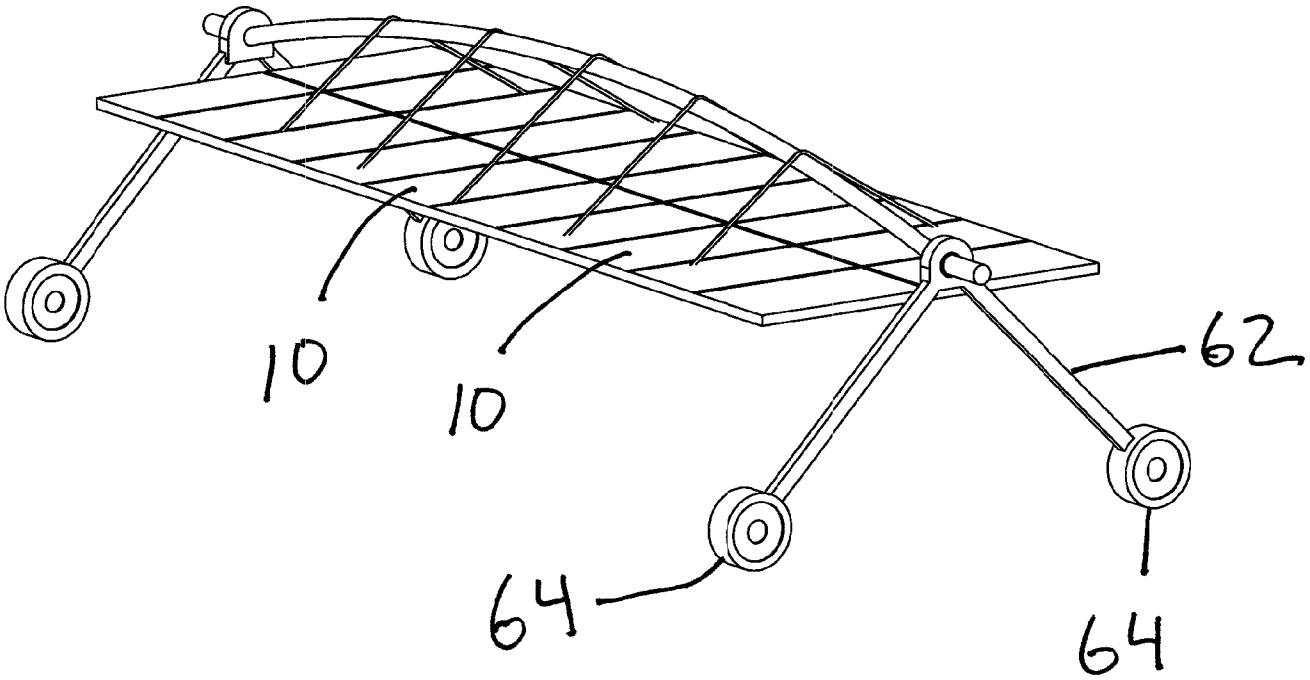
FIG. 14 is a perspective view of flooring sections on a wheeled rack according to the present invention.
Figure 15:
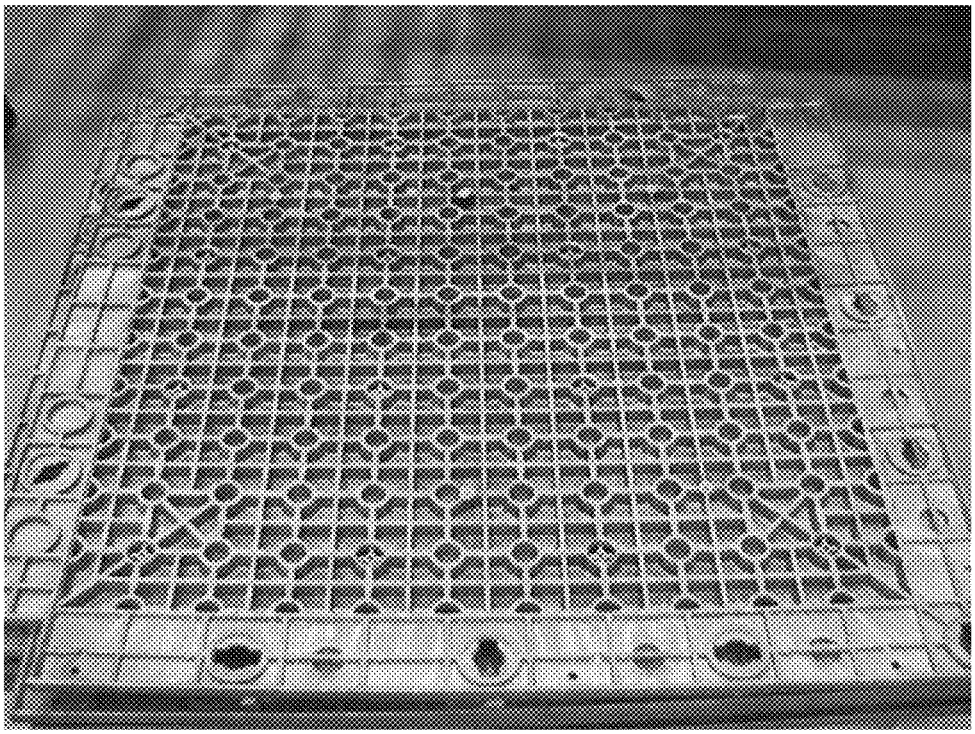
FIG. 15 is a perspective view of a flooring section with different honeycomb pattern according to the present invention.

Having the flooring sections 10 in pallet-size makes the flooring sections 10 easy to move using fork lift equipment. The flooring sections 10 may be placed directly on the turf, allowing construction equipment to safely carry event-staging materials over the turf. When the flooring sections 10 are combined, an ideal product for event staging on natural turf is created and therefore minimizing injury to the turf. The flooring sections 10 become a protective surface that can be driven on, while providing the light-emitting lighting strips 42 on the bottom 14 of flooring section 10 to face the grass surface they are resting on. One can grow turf and protect turf in the wintertime using the flooring sections 10 and could drive snowplows over turf, while still providing light to turf. The LEDs 41 of the lighting strips 42 supply light to the turf that the flooring sections 10 are resting on and allow photosynthesis to continue uninterrupted. The LEDs 41 of each flooring section 10 are designed to provide wavelengths of light between 200 and 800 nm from the lighting strips 42. Wavelengths of 400 to 700 nm are referred to as photosynthetically active radiation (PAR) and that portion of the solar spectrum visible to the human eye. In plants, production of pigments chlorophylls and carotenoids are also referred to as action spectra that absorb these wavelengths. Chlorophyll a selectively absorbs light within the visible spectrum, peaking at 410, 430 (blue light) and 660 nm (red light). Absorption by chlorophyll b peaks at 430 455 and 640 nm. The carotenoid pigments lutein and β-carotene absorb strongly in the blue region with maximum absorption occurring at 448 and 454 nm. Far-red light is the region of the spectrum between 700 and 800 nm. While not absorbed by chlorophyll for photosynthesis, it has a strong influence on photomorphogenesis, which is a term that describes how light influences plant architecture. For optimum results, the system should be placed over non-stressed turf. The flooring sections 10 may be left over the turf for 8 days to 4 months depending on the season to minimize the effect on the ability of the turf to photosynthesize. Light applied to the turf should reflect when the sun comes up and be turned off when the sun goes normally goes down, as the turf needs a break from the light application. 24-hour exposure does not work, where a 4-8 hour period of no light is ideal. Power systems of the flooring sections 10 may need to be cooled. Reparation of the plant increases as temperature increases due to power system, so fans may be required to cool power systems FIGS. 11-12 show the lighting strips 42 replaced with LED filled light pods 60. The LED filled light pods 60 allow for several different color LEDs contained in the light pods 60 to create different light patterns. The top 12 of the floor sections 10 through to the inside surface of the floor sections can be of a transparent or translucent material for light transmission. The light transmission can be used in two ways. First, sunlight can shine through the top 12 to the grass surface below the floor section 10 to aid the lighting strips 42 in providing light to the grass. Second, the LED's can reflect upward through the top 12 to provide light designs and patterns that can be viewed by users or even have some of the LEDs shine directly upward. Light designs viewed by the user can be used to direct patrons before and after an event to make safety pathways. The light transmitted through the top 12 of the flooring sections 10 can act as a light show that goes with the music at the event, while still protecting the turf. The light designs could also be in the form of advertisements. FIG. 13 shows examples of the light showing up through the top 12 of the flooring section 10. The LEDs could shine through the ice of a hockey rink formed on top of the flooring sections 10, while protecting the grass below. The LEDs in the flooring section 10 can be linked to portable music devices, such as MP3 players and iPODs that have wireless communication. The flooring sections 10 can have receivers that detect when someone is on the flooring section 10 and can link up to the portable music devices, such that a light show is produced based on the music played to provide a personal dance floor in stadium. An example is to add one waterproof DMX decoder and three or 4 waterproof RGB amplifiers to each power supply modules of the flooring section 10. Also, a DMX wire or a 4 wire RGB, would be added to the power cord to send a signal to each of the floor sections 10. For stage lighting and effects, by using red, green and blue LED emitters located close to each other, you can adjust their individual intensities to create an almost unlimited palette of colors, rather like a television does, but with much greater brightness, flexibility and scalability. And add a fourth color, amber, to provide even finer control over the mixed shades for those who need it. An example is to have two one port dmx interfaces installed next to each of the power supply modules of the flooring section 10 to control the RGB LEDs in the lighting strips. Each flooring section 10 would be connected through cat 5 wire on a network. iPOD/iPAD, as well as other electronics can act as the DMX controller using wireless technology. FIG. 14 shows the flooring sections 10 supported by a rack 62 by having the flooring sections hang downward from the rack using cables. The rack 62 includes wheels 64 such that a rack 62 of flooring sections 10 can be wheeled onto a grass surface and light applied without placing the flooring sections 10 on the turf. FIG. 15 shows a different honeycomb pattern for the ground support strips 38.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A turf protection system for persevering grass comprising:

lights to continue grass lighting requirements on grass so as to reduce and even prevent grass deterioration;

at least one flooring section having a top, bottom, four sides formed to mate sides of another of said at least one flooring section such to form a flat surface between said tops of said flooring sections, said bottom including ground supports extending from an inside surface of said top adapted to support said at least one flooring section on grass, said bottom including voids between said ground supports to receive attachment of said lights between said ground supports such that said ground supports protect said lights from contacting the grass strips of LED lights attached within said voids being said lights, said LED lights facing downward from said top and adapted to provide light towards grass, whereby said lights provide light to grass when said bottom of said at least one flooring section is placed on grass;

light connections connected to said lights to allow connection to electrical power, said top of said at least one flooring section in combination with said ground supports being construction to support weight of heavy equipment and event stages in order to protect said lights.

2. The turf protection system of claim 1, wherein said lights are multiple strips of LEDs running through said voids, said LEDs producing light in the range of wavelengths form 400 to 800 nm of light.

3. The turf protection system of claim 2, further including LEDs to emit green light.

4. The turf protection system of claim 1, wherein said lights are multiple rectangular light pods that are adapted to face grass, said light pods containing LEDs in each of said light pods which produce light in the range of wavelengths form 400 to 800 nm of light.

5. The turf protection system of claim 4, further including LEDs in each pod to emit green light.

6. The turf protection system of claim 1, further including a clear protective layer covering all of said bottom of each of said at least one flooring section to protect said lights from grass.

7. The turf protection system of claim 1, further including electrical connections to interconnection of lights of two or more of said at least one flooring section.

8. A turf protection system comprising:

lights to continue turf lighting requirements on turf so as to reduce and even prevent turf deterioration;

at least one flooring section having a top, bottom, four sides formed to mate sides of another of said at least one flooring section such to form a flat surface between said tops of said flooring sections, said bottom including ground supports extending from an inside surface of said top to support said at least one flooring section on a surface, said bottom including voids between said ground supports to receive said lights between said ground supports such that said ground supports protect said lights from contacting said surface that said flooring sections are supported from, said lights attached within said voids facing downward to provide light towards said bottom of said flooring section and the surface such that said lights provide light to the turf when said bottom of said at least one flooring section is placed on turf;

light connections connected to said lights to allow connection to electrical power, said top of said at least one flooring section in combination with said ground supports being construction to support weight of heavy equipment and event stages in order to protect said lights; and wherein two of said four sides of said at least one flooring section are two key sides and two of said four sides of said at least one flooring section are two key receiving sides, said key sides formed to mate with key receiving sides of another of said at least one flooring section such to form a flat surface between said tops of said at least one flooring sections which are attached together.

9. The turf protection system of claim 8, wherein said key sides include at least two keys, said key configured to engage at least two key holes in each of said key receiving sides.

10. The turf protection system of claim 8, wherein said two key sides include lights embedded in said sides and said key receiving sides include light openings to allow said lights embedded in said key sides to shine towards grass when two of said at least one flooring section are attached together.

11. The turf protection system of claim 1, wherein said ground supports crisscross to form said voids in a honeycomb structure.

12. The turf protection system of claim 1, wherein said top and said inside surface is of a translucent material and each of said at least one flooring section includes space around said lights adapted to allow light to reflect up from grass and pass between said top and said inside surface to be seen from said top.

13. The turf protection system of claim 1, further including a rack with wheels, said rack having two ends of a triangle shape, wherein said ends each have said wheels attached and wherein said at least one flooring section is attached to said rack between said ends and is suspended above grass, such that said at least one flooring section can be wheeled about grass.

14. The turf protection system of claim 1, wherein said lights are LEDs, further including electronic controls connected to said lights to control patterns of lights, wherein said top is of a translucent material to allow light from said lights to pass between said top and said inside surface, such that said lights can be viewed from said top.

15. The turf protection system of claim 1, wherein combination of said ground supports and said top can withstand an applied weight of up to 1,056 pounds per square inch when said at least one flooring section is on a turf surface.

16. A method of protecting grass when covered and weight is applied to material covering the grass comprising:

providing a covering material which can sit on the grass and withstand an applied weight of up to 1,056 pounds per square inch when the covering material is on the grass; and providing lights within the covering material to aid in preserving grass, where the lights are provided in such a manner as that the lights do not contact the grass under the covering material and provided in such a manner that weight applied to the covering material does not damage the lights, wherein the lights are strips of LED lights attached within voids of the covering material, wherein the LED lights face downward from covering material to provide light towards grass and wherein the lights provide light to grass when said bottom of said at least one flooring section is placed on grass.

17. The method of claim 16, further including providing the covering material in sections which can be combined together to provide a level surface and providing electrical connections to interconnect lights between the provided sections.

18. The method of claim 16, further including providing light in the range of wavelengths form 400 to 800 nm of light using LEDs.

19. The method of claim 16, further including providing a translucent material covering so the lights can also shine upward through the material towards the user, providing LEDs for the lights and providing a electronic controls to control the lights in different patterns.

* * * * *